United States Patent [19]

Sakamoto et al.

[11] Patent Number: 4,891,182

[45] Date of Patent: Jan. 2, 1990

[54] PROCESS FOR MAKING POROUS MASSES OF IRON, NICKEL, TITANIUM, AND OTHER METALS

[75] Inventors: Michiru Sakamoto; Akira Kitahara; Hidetoshi Ueno; Sumio Nagata, all of Tosu, Japan

[73] Assignee: Agency of Industrial Science & Technology, Tokyo, Japan

[21] Appl. No.: 325,976

[22] Filed: Mar. 20, 1989

[30] Foreign Application Priority Data

Mar. 31, 1988 [JP] Japan ..... 63-81045

[51] Int. Cl.[4] ..... B22F 3/10

[52] U.S. Cl. ..... 419/2; 419/19; 419/27; 419/38; 419/49; 419/45; 419/44; 75/228

[58] Field of Search ..... 419/2, 38, 44, 45, 49, 419/19, 27; 75/228

[56] References Cited

U.S. PATENT DOCUMENTS 4,174,364 11/1979 Balosetti ..... 419/2
4,614,637 9/1986 Boncoeur et al. ..... 419/2
4,707,184 11/1987 Hashiguchi et al. ..... 75/228

*Primary Examiner*—Stephen J. Lechert, Jr.
*Assistant Examiner*—Nina Bhat
*Attorney, Agent, or Firm*—Oblon, Spivak, McClelland, Maier & Neustadt

[57] ABSTRACT

A process for making a porous mass of a metal of iron- or titanium-group comprises steps of forming a sinter of solvent-soluble particles, pressing in a molten metal of the iron- or titanium- group into open interstices in the sinter, and eluting the particles from the composite of the sinter and metal. Solvent-soluble magnesia particles whose surface is either covered or not with a film of boric anhydride or solvent-soluble calcia particles whose surface is either covered or not with film of calcium chloride are sintered and machined into the desired shape. The formed sinter is put in a case of a heat-insulating material that can withstand the melting temperature of a metal of iron- or titanium-group. After being heated to a given temperature together with the case, the sinter is immediately put in a metal mold where a molten metal of iron- or titanium-group is pressed into open interstices in the sinter. Then, only the particles are eluted from the sinter-metal composite by a solvent.

10 Claims, 2 Drawing Sheets

PROCESS FOR MAKING POROUS MASSES OF IRON, NICKEL, TITANIUM, AND OTHER METALS

FIELD OF THE INVENTION

This invention relates to a process for making porous masses of metals for use as high-functional materials for oilless bearings, filters and many other applications, and more particularly to a process for making porous masses of iron, nickel, titanium or alloys made up essentially of such metals.

DESCRIPTION OF THE PRIOR ART

Porous masses of metals having a linked network of pores are made by several processes. One of such processes directly sinters particles of material metal. Another process (Japanese Patent Public Disclosure No. 49703 of 1985) presses a molten metal into open interstices left in a formed mass of particles soluble in solvent, after the metal has been solidified, the particles are eluted from the solidifed mass by the action of a solvent.

Especially porous masses of metals made by the latter process have as high a porosity as 50% to 85%, other features such porous masses of metals have include the ease with which the size and shape of pores can be controlled. Prior to the elution of the soluble particles, in addition, the solidified mass can be machined to the desired shape without causing loadings in the particles-filled interstices that are to become pores later. Actually, however, this process has been limited to the making of porous masses of lead, tin, zinc and aluminum and their alloys using sodium chloride as the soluble particles and those of copper and its alloys using potassium phosphate as the soluble particles. The process has not been applied to the making of porous masses of iron and nickel and their alloys (hereinafter generically called the iron-group metals) and those of titanium and its alloys.

The reason for that has been two-fold: One is due to the lack of such solvent-soluble particles as can withstand the high melting temperatures of the iron-group and titanium-group metals. The other is due to the lack of techniques to press in the molten metal of the iron-group etc. into open interstices among the particles in the formed mass.

SUMMARY OF THE INVENTION

The object in general of this invention is to find a solvent-soluble granular material that can withstand the high temperature of the melt of a metal of the iron-group or titanium-group that is pressed therein, that can form a composite with the pressed-in metal of the iron- or titanium-group, and that, following the forming of the composite, allows only the particles of the solvent-soluble material to elute by use of a solvent, thereby to provide a process of making a porous of one or more of said metals.

To obtain such solvent-soluble granular materials, the inventors conducted researches and experiments to confirm that various kinds of oxides can withstand the high temperatures of molten metals of the iron- and titanium-group. Such oxides were found to remain stable even at as high a temperature as 1650° C., without causing chemical reaction with such hot metals. Also, studies were made to find such materials as would permit only the particles of such oxides to elute without damaging the metals. Consequently, magnesia, a mixture of magnesia and boric anhydride, calcia or a mixture of calcia and calcium chloride were found to be suited for the purpose.

An object of this invention based on such findings is to provide a process for making porous masses of metals by using magnesia, a mixture of magnesia and boric anhyride, calcia or a mixture of calcia and calcium chloride.

Especially a sinter made from a mixture of magnesia and boric anhydride or a mixture of calcia and calcium chloride assure a firm bond between the particles in contact with each other. Therefore, another object of this invention is to provide a process for making porous masses of metals which permits readily forming a linked network of pores by taking advantage of the characteristic just mentioned.

Still another object of this invention is to provide a process for readily making porous masses of metals having a linked network of pores with high porosity using such metals as iron, nickel and titanium or alloys thereof that have relatively high melting points.

Yet another object of this invention is to provide a process for making porous masses of metals, which suits to use a sinter of said particles and is adapted to readily press a molten metal in the sinter.

A further object of this invention is to provide a process for making porous masses of metals with a mold of steel or other metals which are not very strong at high temperatures by eliminating the need to preheat the metal mold before pressing a molten metal into said sinter.

Other objects of this invention will be made clear in the following detailed description of the preferred embodiments and examples of this invention.

In order to achieve the above objects, a process for making porous masses of metals according to this invention uses particles of magnesia (MgO) alone, solvent-soluble particles prepared by applying boric anhydride ($B_2O_3$) on the surface of magnesia particles, particles of calcia (CaO) alone or solvent-soluble particles prepared by applying calcium chloride($CaCl_2$) on the surface of calcia particles. The particles are sintered into a desired shape depending on the final shape of porous masses of metals to be produced therefrom. The obtained sinter is put in a case of a porous heat-insulating material which can withstand the melting temperature of a metal of the iron- or titanium-group to be poured in later, for heating to a given temperature. The heated sinter is then put in a metal mold where a molten metal of the iron- to titanium-group is pressed into open interstices among the particles of the sinter. Using nitric acid, sulfuric acid or chelating agent as a solvent, only particles of the sinter are eluted from the composite of the sintered material and metal.

DESCRIPTION OF THE PREFERRED EMBODIMENTS

Figure 1:
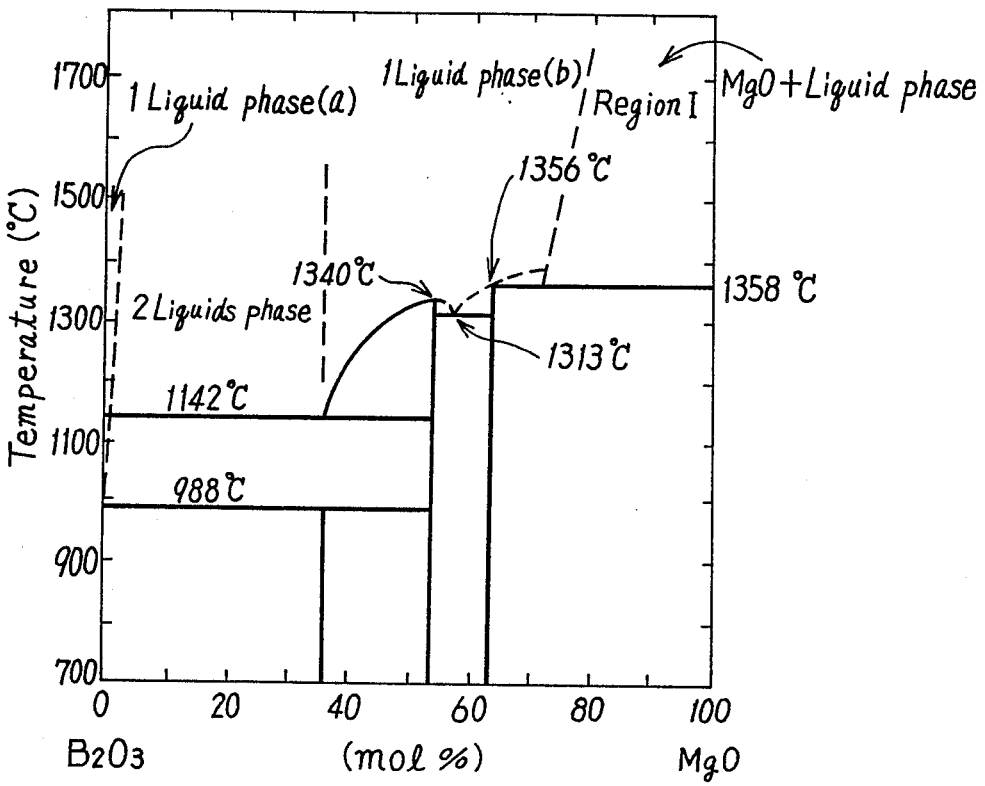
FIG. 1 is a magnesia-boric anhydride constitution diagram.

A process for making porous masses of metals of the iron- and titanium-group according to this invention comprises the steps of sintering a mass of solvent-soluble particles, pressing a molten metal of iron- or titanium-group into open interstices among particles of the sintered mass, and eluting the particles from the sinter metal composite.

In a forming step of a mass of solvent-soluble particles, the mass is formed in a condition that all contacting points of solvent-soluble particles filled in a container are formed as linking portions of the particles. And it is the purpose of linking among all the particles that; at the later step of eluting, said eluting of the particles which starts from the surface of the composite proceeds to the inner area through the linking portions. The presence of the linking portions among the particles permits the complete removal of the particles by elution, thus assuring the making of a porous mass of metal having a satisfactory network of pores.

Linking of particles is usually achieved by a heat treatment known as sintering. But particles of pure magnesia or calcia are difficult to sinter, and particularly so when particles are coarse. In general, since attainment of high-density is an overriding consideration in the making of magnesia or calsia sinters, parcicles of the starting material which either finely granulated or mixed until a desirable particle size distribution are prepared before being sintered. Thereby, despite inherent difficulty in sintering, sinters having as high a packfill density as 90–95% are obtainable.

But packfill density of magnesia or calcia sinters for use in a process of making porous masses of metals should not be raised so freely because of the need to press in a molten metal into open interstices among the particles. Let us geometrically determine the packfill density of spherical particles of a same size filled in a container. The loosest packfill density is 53.4%, while the tightest one is 74%. Beyond this tightest packfill density, some open interstices among the particles become isolated from other interstices. Molten metal cannot be pressed into such isolated open interstices. In the making of a throughly porous mass of a metal, therefore, the packfill density of a sinter should not be higher than the tightest theoretical packfill density of 74% of spherical particles. To assure this, such a forming method for a mass of particles must be employed that linking among the particles is only at points where they are in contact with each other.

Using particles of pure magnesia or calcia, a formed mass of particles which has strong linking at contact points among each particles but the packfill density after sintering does not excessively increase compared to presintering, can be obtained by adding boric anhydride on magnesia particles or adding calcium chloride on calia particles as a sintering assistant. Usually, many other kinds of oxides (such as BeO, CaO, SrO, BaO, FeO, CoO, NiO, $Al_2O_3$ and $SiO_2$) are used as an assistant in the making of high-density magnesia sinters and many kinds of oxides (such as $Fe_2O_3$, $Cr_2O_3$, $V_2O_5$, $MnO_2$, CoO, $TiO_2$, $Ca(PO_4)_2$, MgO, ZnO, $ThO_2$, $ZnO_2$ and $SnO_2$) are used as an assistant in the making of high-density calcia sinters. But the products of reaction between such oxides and magnesia or calcia at high temperatures are much less soluble than metals of iron- or titanium-group to various kinds of solvents. In the making of porous masses of metals, which involves the elution of particles only from the sinter-metal composite, therefore, aforementioned oxides are not suited for use as an assistant for the sintering.

For a sinter whose starting material is particles of magnesia added with boric anhydride, to ensure forming of linking portions only at contact points of the particles, addition of boric anhydride to the magnesia particles should preferably carried out as follows: A saturated solution of boric anhydride in ethyl alcohol is added to magnesia particles. The mixture is well kneaded until the surface of the magnesia particles are throughly wetted with the solution. Kneading is further continued, while paying attention not to cause the particles to adhere together, to evaporate alcohol. Then, particles of a magnesia-boric anhydride composite uniformly covered with a thin film of boric anhydride are obtained. A desired sinter of the particles can be obtained by heating the particles of the composite in a container at a suitable temperature. For a sinter of calcia particles adding calcium chloride, the similar process can be applied.

FIG. 1 is a magnesia-boric anhydride constitution diagram. Obviously, sintering of the composite particles thus obtained is best accomplished under the conditions in region I in which the highest metling point is included. Sintering in this region is performed with an addition of boric anhydride of not more than 30 mole % and at a temperature of not lower than 1358° C. For sintering of calcia, the sintering temperature is not lower than 774° C. since the melting temperature thereof is 774° C. and adding 10 weight % of calcium chloride is enough.

When sintered at temperature within said range, dissolution occurs in the thin film of boric anhyride or calcium chloride which uniformly covers the surface of magnesia or calcia particles, and surface of magnecia or calcia particles is uniformly covered with liquid layer of an intermediate composite of magnesia and boric anhydride or calcia and calcium chloride. By action of wetting and surface tension, the liquid layer flows to collect where particles contact with each other. On being cooled, the collected liquid forms solid, firm bonds only where particles contact with each other.

The sinter of the solvent-soluble particles thus obtained must be preheated to a suitable temperature before proceeding to the next step of pressing in a molten metal of the iron- or titanium-group into open interstices therein. Also, the sinter must be put in a mold that is solid enough to withstand the force resulting from the pressing-in of the molten metal. In making a porous mass of aluminum according to a conventional process (Japanese Patent Public Disclosure No. 49703 of 1985), for example, a sinter of particles is put in a mold of steel and the sinter and mold are preheated together, with molten aluminum pressed in on completion of preheating because the preheating temperature is relatively low (as low as 500°–600° C.)

In the making of porous masses of metals of the iron- or titanium-group, on the other hand, a sinter of particles into which a molten metal of those groups is to be pressed must be preheated to a temperature over 1000° C. A mold used in such process must have a a high resistance to oxidation, high mechanical strength and high resistance to thermal impact at said preheating temperature. In addition, the mold must not cause fusion even when it comes in contact with a molten metal at a temperature of 1500° C. to 1700° C. under a certain pressure. This type of molds can be made of only rare and costly materials. And it is practically impossible to preheat such expensive molds together with a sinter of particles into which a molten metal of the iron-group etc. at a high temperature is pressed.

In the process of this invention, therefore, the sinter of particles is preheated alone, not with a metal mold.

Then, a molten metal of the iron- or titanium-group is pressed into the prheated sinter.

To be more specific, a sinter of particles is put in a case of a porous heat-insulating material which can withstand the melting temperature of a metal of the iron- or titanium-group, and, then, preheated to a given temperature. On completion of preheating, the sinter, together with the case, is put in a steel mold. Then, a molten metal of the iron- or titanium-group is immediately pressed in through many pores in the heat-resisting material. The case may be made of a compact or fireproof fibers of such materials as alumina and silicon carbide. A case of these materials have a high enough heat-insulating property to keep the temperature of the sinter contained therein from falling even when the case is put in a steel mold. This eliminates the need for preheating the mold in which a molten metal is pressed in. This, in turn, eliminates the need for preparing a mold of special material and the problem of fusion between the mold and molten metal. Accordingly, a steel mold suffices for use in the step of pressing in a molten metal of the iron- or titanium-group.

Figure 2:
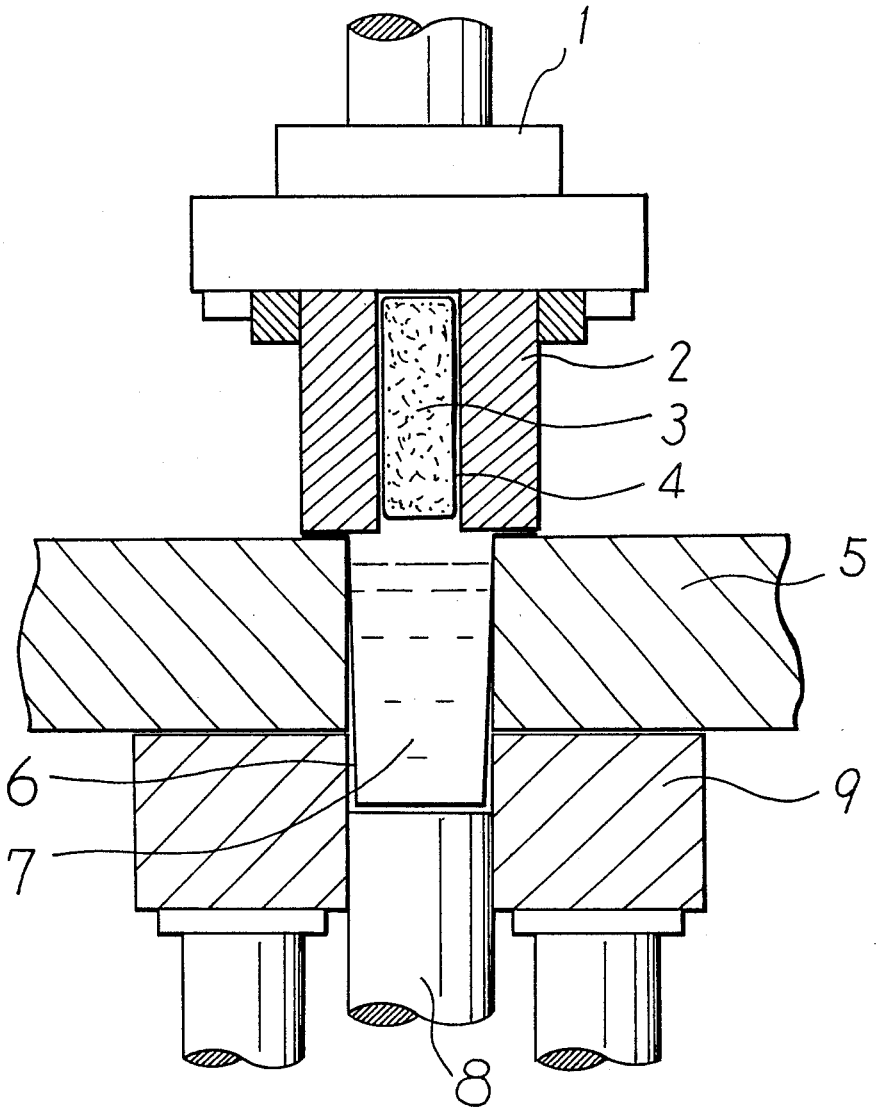
FIG. 2 is a cross-sectional view of an embodiment which shows a press caster to press in a molten metal.

FIG. 2 shows an example of a press caster employed for the pressing-in of a molten metal. A metal mold 2 held by an upper press 1 carries a case 4 of a porous heat-insulating material containing a sinter 3 of particles. A molten metal 7 contained in a heat-insulating wool 6 and a hot-metal cylinder 5 is pressed into the sinter 3 of particles by the action of a center knock press 8. Reference numeral 9 designates a lower press.

The step of eluting the particles from a sinter-metal composite thus obtained is as follows: The cooled and solidified composite is stripped from the case of the porous heat-insulating material and machined into the desired shape, as required. Then, only the particles are eluted by use of a solvent to leave a porous mass of a metal of iron- or titanium-group, the solvent is nitric or sulfic acid for magnecia particles or a mixture of magnecia particles and boric anhydride, and chelating agent for calcia particles or a mixture of calcia particles and calcium chloride. In this eluting process, the metal of iron- or titanium-group becomes insoluble to the solvent by forming a passive film therearound, therefore, it is only the particles of magnesia and the like that elutes from the composite.

EXAMPLE 1

Particles of magnesia, 350 μm in diameter, were tamped into a container of graphite having an inside diameter of 30 mm and a height of 80 mm. A sinter of particles was obtained by sintering the packed material in a hot press at a temperature of 1720° C. and under a pressure of 68 kg/m$^2$ for one hour. The sinter was put in a porous heat-insulating case made of compacts of alumina ($Al_2O_3$) fibers having a mean diameter of 3 μm and a mean length of 100 μm. The sinter and the case were preheated together to 1350° C. On completion of the preheating, the sinter and the case were immediately put in a steel mold having an inside diameter of 50 mm and a height of 100 mm. Then, molten 18% Cr-8% Ni stainless steel at 1650° C. was immediately pressed in under a pressure of 150 kg/cm$^2$ to produce a sinter-metal composite. The cooled and solidified composite was machined into the desired shape. The machined composite was then immersed in a 6N solution of nitric acid serving as a solvent to elute only the particles. Consequently, a porous mass of stainless steel having a porosity of 60.5% was obtained.

EXAMPLE 2

Particles of magnesia, 350 μm in diameter, were well kneaded with a saturated solution of alcohol borate until alcohol evaporated. This produced the particles of a composite, with the amount of boric anhydride covering the surface of the particles of magnesia adjusted to 2 mole %. The particles were tamped into a container of graphite having an inside diameter of 30 mm and a height of 80 mm. A sinter of the particles was obtained by sintering the packed material for 1 hour at a temperature of 1365° C. that is within the region in which both MgO and 2% $B_2O_3$ coexisted as a solid and a liquid. The sinter was put in a case of a porous heat-insulating material similar to the one used in Example 1, which were then preheated together to a temperature of 1350° C. On completion of the preheating, the sinter and the case were immediately put in a steel mold having an inside diameter of 50 mm and a height of 100 mm. Then, molten 18% Cr-8% Ni stainless steel at 1650° C. was immediately pressed in under a pressure of 150 kg/cm$^2$ to produce a sinter-metal composite. The cooled and solidified composite was machined into the desired shape. The machined composite was then immersed in a 6N solution of nitric acid serving as a solvent to elute only the particles. Consequently, a porous mass of stainless steel having a porosity of 60.7% was obtained.

EXAMPLE 3

Particles of calcia, 250 μm in diameter, were well kneaded with a saturated solution of alcohol calcium chloride until alcohol evaporated. This produced the particles of a composite, with the amount of calcium chloride covering the surface of the particles of calcia adjusted to 6 weight %. The particles were tamped into a container of graphite having an inside diamter of 30 mm and a height of 80 mm. A sinter of the particles was obtained by sintering the packed material for 1 hour at a temperature of 900° C. The sinter was put in a case of a porous heat-insulating material similar to the one used in Example 1, which were then preheated together to a temperature of 1100° C. On completion of the preheating, the sinter and the case were immediately put in a steel mold having an inside diameter of 50 mm and a height of 100 mm. Then, molten eutectic cast iron at a temperature of 1400° C. was immediately pressed in under a pressure of 150 kg/cm$^2$ to produce a sinter-metal com composite. The cooled and solidified composite was machined into the desired shape. The machined composite was then immersed in a chelating agent (DISSOLVINE made by LION CORPORATION) whose pH is adjested in an alkali region serving as a solvent to elute only the particles. Consequently, a porous mass of cast iron having a porosity of 58.0% was obtained.

EXAMPLE 4

A sinter-metal composite was obtained by pressing in molten nickel at a temperature of 1550° C. under a pressure of 150 kg/cm$^2$ into a sinter of MgO-$B_2O_3$ that was prepared and preheated to a temperature of 1300° C. by the same method as that used in Example 1. The cooled and solidified composite was machined into the desired shape. The machined composite was then immersed in a 6N solution of sulfuric acid serving as a solvent to elute only the particles. Consequently, a porous mass of nickel having a porosity of 60.5% was obtained.

What is claimed is:

1. A process for making a porous mass of a metal which comprises steps of putting a sinter of magnesia or calcia particles formed into a desired shape in a heat-insulating case, heating the sinter to a given temperature together with the case, putting the heated sinter in a metal mold, pressing in a melt of iron, nickel, titanium or an alloy of each of said metals or a composite alloy thereof into the sinter to make a composite mass, and eluting only the sinter from the cooled and solidified composite mass by use of a solvent.

2. A process for making a porous mass of a metal which comprises the steps of putting a composite sinter of particles of a mixture of magnesia particles and boric anhydride or a mixture of calcia particles and calcium chloride formed into a desiredshape in a heat-insulating case, heating the sinter to a given temperature together with the case, putting the heated sinter in a metal mold, pressing in a melt of iron, nickel, titanium or an alloy of each of said metals or a composite alloy thereof into the sinter to make a composite mass, and eluting only the sinter from the cooled and solidified composite mass by using a solvent.

3. A process for making a porous mass of a metal according to claim 2, in which the composite sintered mass is a formed mass of particles which are a mixture of magnesia particles and boric anhydride and an amount of the boric anhydride added to the particles of magnesia is not more than 30 mole % of the total amount of the mixture.

4. A process for making a porous mass of a metal according to claim 2, in which a solution of boric anhydride in alcohol is added to the particles of magnesia for making a mixture of magnesia particles and boric anhydride, and a solution of calcium chloride in alcohol is added to the particles of calcia for making a mixture of calcia particles and calcium chroride.

5. A process for making a porous mass of a metal according to claim 4, in which a saturated solution of boric anhydride in ethyl alcohol is added to the particles of magnesia, the mixture is kneaded to wet the surface of the magnesia particles with the saturated solution, and composite particles of magnesia and boric anhydride whose surface is uniformly covered with a thin film of boric anhydride are obtained by allowing the alcohol to evaporate while continuing kneading.

6. The process for making a porous mass of a metal according to claim 4, in which a saturated solution of calcium chloride in ethyl alcohol is added to the particles of calcia, the mixture is kneaded to wet the surface of the calcia particles with the saturated solution, and composite particles of calcia and calcium chloride whose surface is uniformly covered with a thin film of calcium chloride are obtained by allowing the alcohol to evaporate while continuing kneading.

7. A process for making a porous mass of a metal according to claim 1 or 2, in which the metal mold is made of steel.

8. A process for making a porous mass of a metal according to claim 1 or 2, in which the heat-insulating case is made of a porous compact of fireproof fibers of alumina or silicon carbide.

9. A process for making a porous mass of a metal according to claim 1 or 2, in which nitric acid or sulfuric acid is used as the solvent for the sinter of magnesia particles or a mixture of magnesia particles and boric anhydride.

10. A process for making a porous mass of a metal according to claim 1 or 2, in which chelating agent is used as the solvent for the sinter of calcia particles or a mixture of calcia particles and calcium chloride.

* * * * *